US006626112B1

(12) United States Patent
Chiu

(10) Patent No.: US 6,626,112 B1
(45) Date of Patent: Sep. 30, 2003

(54) METHOD OF SUCCESSIVELY AND AUTOMATICALLY TRANSFER PRINTING AN INTEGRAL DESIGN ON THE LEAVES OF A BLIND WITH ONE ROUND OF PROCESSING

(76) Inventor: Chin-Yung Chiu, No. 2, Alley 25, Lane 25, Guojung 1 st Rd., Dali City, Taichung, 412 (TW)

( * ) Notice: Subject to any disclaimer, the term of this patent is extended or adjusted under 35 U.S.C. 154(b) by 0 days.

(21) Appl. No.: 10/136,296

(22) Filed: May 2, 2002

(51) Int. Cl.[7] ..... B41F 23/04
(52) U.S. Cl. ..... 101/487; 101/485; 101/37
(58) Field of Search ..... 101/33, 34, 35–37, 101/372–373, 485–488, 492; 156/230, 234

(56) References Cited

U.S. PATENT DOCUMENTS 4,399,178 A * 8/1983 Barta ..... 428/202
4,462,853 A * 7/1984 Ringer ..... 156/238
6,286,920 B1 * 9/2001 Ridgway ..... 347/2
6,378,421 B1 * 4/2002 Chiu ..... 101/35
2001/0013283 A1 * 8/2001 Pfundstein et al. ..... 101/35
2003/0041751 A1 * 3/2003 Chiu ..... 101/35

* cited by examiner

*Primary Examiner*—Ren Yan
*Assistant Examiner*—Marissa Ferguson
(74) *Attorney, Agent, or Firm*—Troxell Law Office PLLC

(57) ABSTRACT

A method of successively and automatically transfer printing an integral design on the leaves of a blind with one round of processing includes steps of conveying both the leaves of a blind and a transfer printing paper roll automatically and press them together in a thermo-transfer printing device. Thus, the designs of the transfer printing paper roll can be automatically transferred and printed on the leaves of a blind, which has an integral design after combined together.

9 Claims, 5 Drawing Sheets

METHOD OF SUCCESSIVELY AND AUTOMATICALLY TRANSFER PRINTING AN INTEGRAL DESIGN ON THE LEAVES OF A BLIND WITH ONE ROUND OF PROCESSING

BACKGROUND OF THE INVENTION

This invention relates to a method of printing a decorative design on the leaves of a blind, particularly to one capable of successively and automatically transfer printing an integral design on the leaves of a blind with one round of processing.

Conventionally, a thermo-transfer printing method is commonly applied for printing designs on the leaves of a blind. Based on such a method, designs expected to be printed are first made and processed on a thermo-transfer printing paper, and subsequently the leaves needed in number of a blind are orderly and manually arranged and placed firmly on a mold. Next, the thermo-transfer printing paper with designs is placed on the leaves of a blind and compressed by the mold of a thermo-transfer printing machine is compressed by applying an extremely high printing temperature and high pressure to make the designs on the thermo-transfer printing paper transferred and printed on the surface of the leaves of a blind.

However, according to such a conventional method, the leaves of a blind have to be first arranged and placed on a mold one by one orderly by hand, and then carry on transfer printing designs on them, so it takes much time to carry on the processing, thus lowering producing efficiency and elevating producing cost.

SUMMARY OF THE INVENTION

This invention is devised to offer a method of successively and automatically transfer printing an integral design on the leaves of a blind with one round of processing, possible to automatically convey the leaves of a blind and the transfer printing paper roll to be compressed together in a thermo-transfer printing device to make the designs transferred and printed on the leaves of a blind with one round of processing, obtaining an integral design on the leaves of a blind after the leaves are combined to form a blind.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
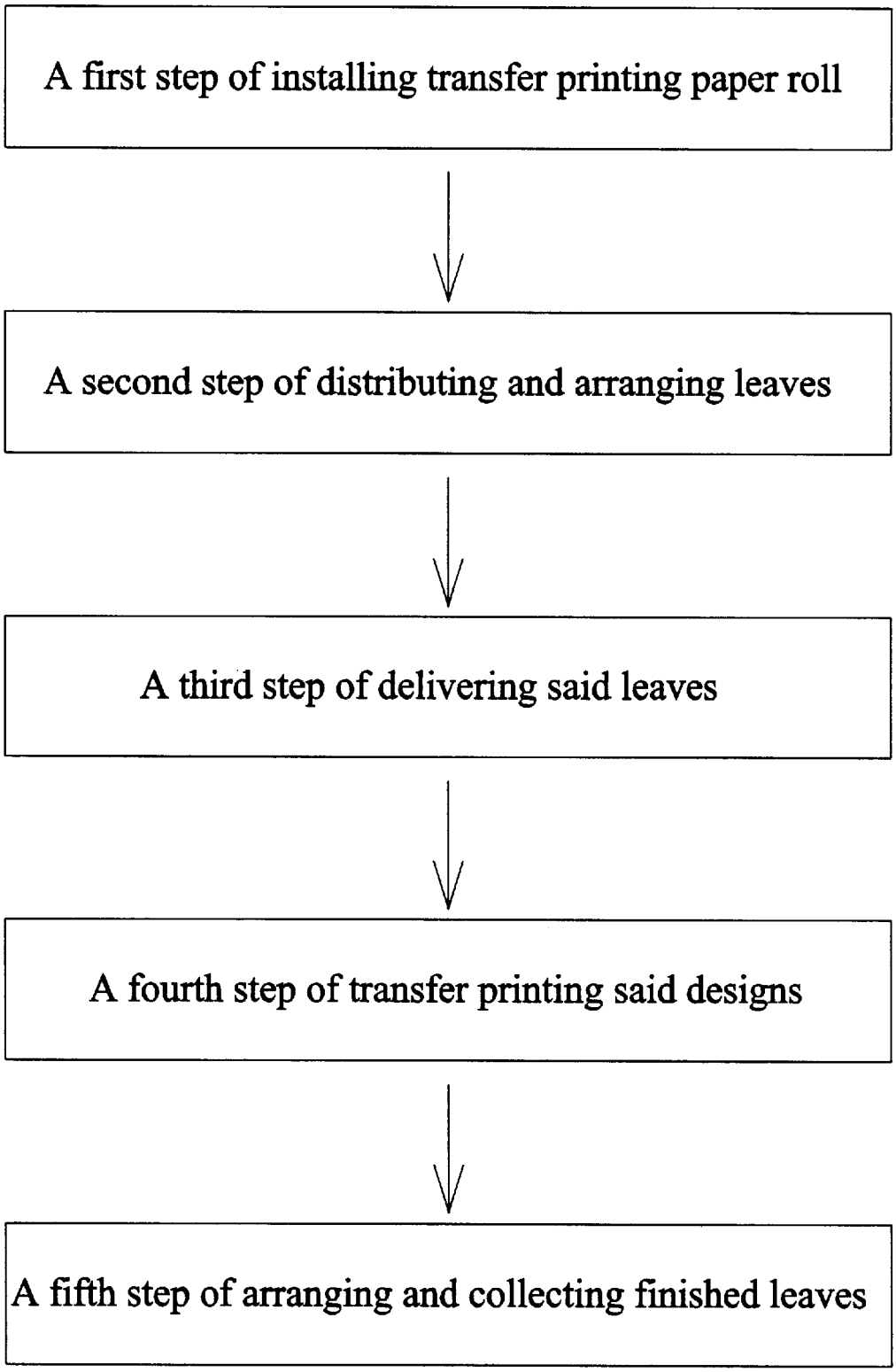
FIG. 1 is block diagram of a preferred embodiment of a method of successively and automatically printing an integral design on the leaves of a blind in the present invention.
Figure 2:
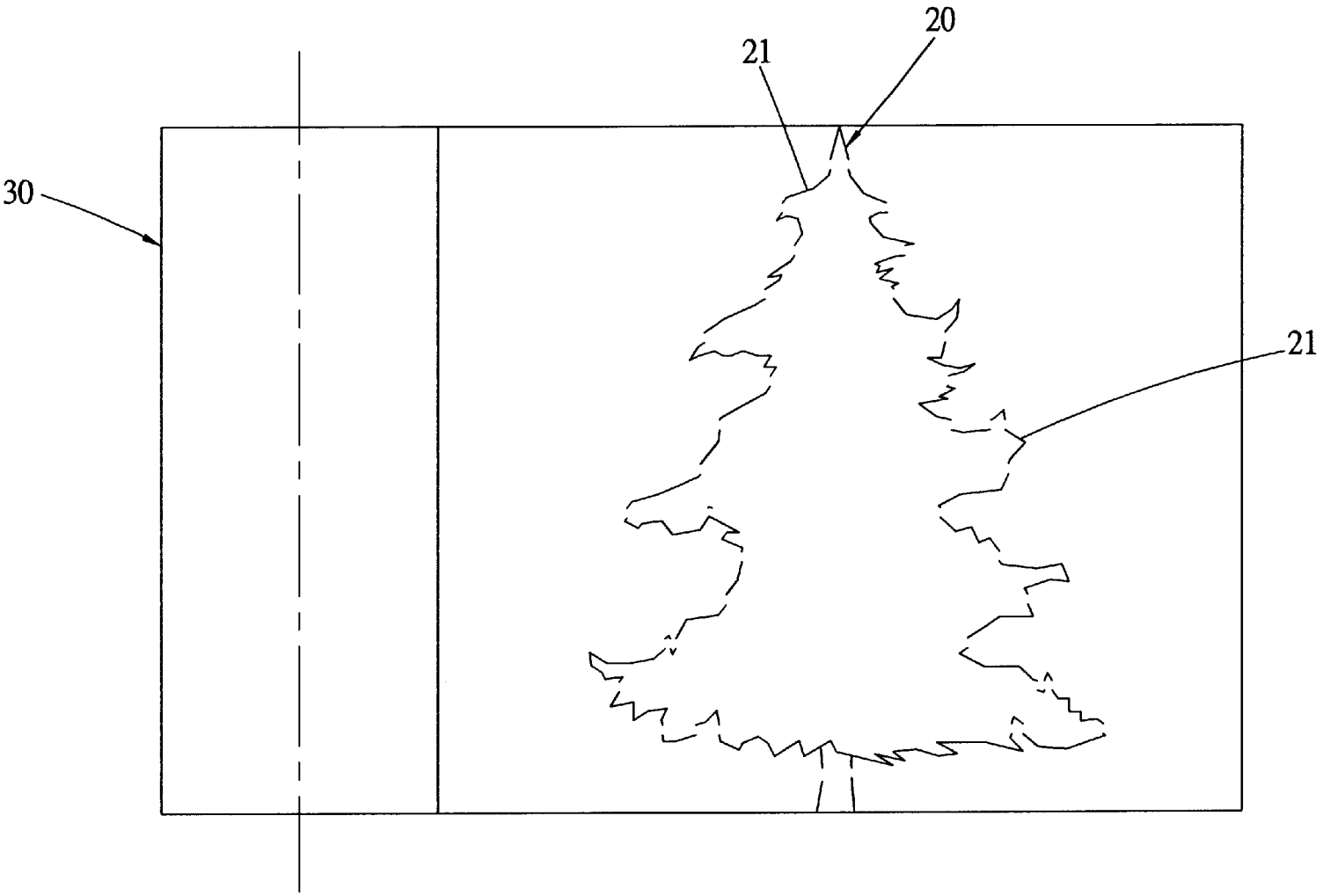
FIG. 2 is an upper view of a transfer printing paper roll with designs in the preferred embodiment in the present invention.

A preferred embodiment of a method of successively and automatically transfer printing an integral design on the leaves of a blind with one round of processing in the present invention, as shown in FIGS. 1 and 2, includes the following steps, in which a blind 10 and its leaves 11 are made of aluminum alloy.

1. A First Step of Installing Transfer Printing Paper Roll:

A design 20 to be transfer printed is first cut into small designs 21 , which are printed on a transfer printing paper roll 30. Next, the transfer printing paper roll 30 is placed on a rotating shaft 40 and pulled out to pass through a thermo-transfer printing device 50 and then wound stably on a winding roller 60 which is able to rotate and move forward the transfer printing paper roll 30.

Figure 3:
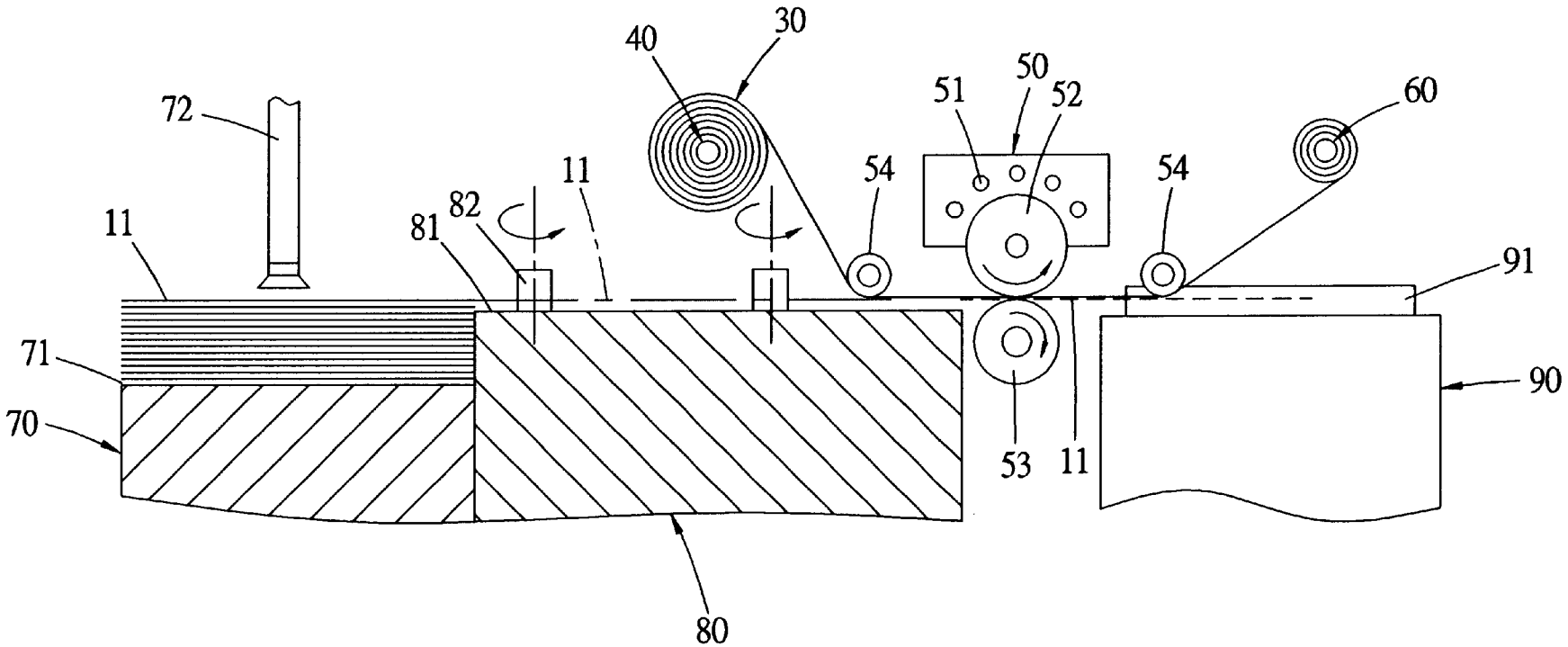
FIG. 3 is a cross-sectional view of the preferred embodiment of the method of successively and automatically printing an integral design on the leaves of a blind in the present invention.

A thermo-transfer printing device 50, as shown in FIG. 3, is composed of a heater 51, a transfer printing roller 52, a support roller 53 and two inertia rollers 54. The heater 51 carries on heating by electric energy produced by an electric heating tube or an electric heating board to generate a high temperature of 100–120 C. The transfer printing roller 52 is a silica gel one pivotally positioned under the heater 51 and heated by the heater 51 to maintain a predetermined transfer printing temperature of 100–120 C. The support roller 53 is a silica gel one oppositely contacting and synchronously rotating together with the tranfer-printing roller 52. The two inertia rollers 54 are respectively located at opposite sides of the transfer printing roller 52 and between the rotating shaft 40 and the winding roller 60 to steadily hold the transfer printing paper roll 30 to make it extend and move forward smoothly under the transfer printing roller 52.

2. A Second Step of Distributing and Arranging Leaves:

Leaves 11 of a blind 10, having the same sizes of the small designs 21, are picked up and respectively placed in separated recesses 71 of a material distributing device 70, with an equal number of leaves 11 piled up in each separated recess 71.

3. A Third Step of Delivering the Leaves:

A sucking disk 72 is provided above each separated recess 71, having a pressure sucking function, and able to orderly suck up the uppermost one of the leaves 11 and then carry this leaf 11 to a rail space 81 of a material delivering device 80.

Figure 4:
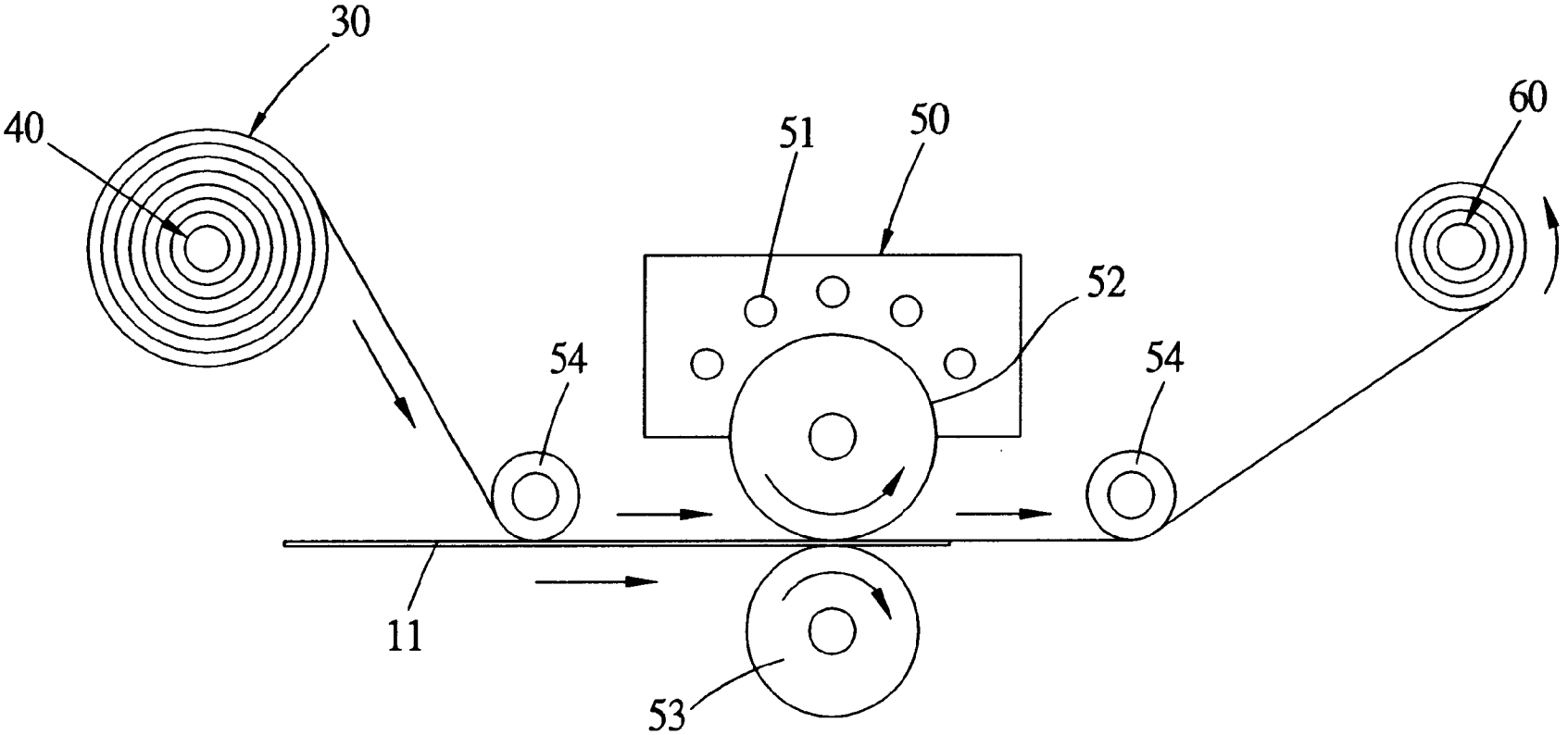
FIG. 4 is a cross-sectional view of a thermo-transfer printing device and the leaves being transfer printed in the preferred embodiment in the present invention.

4. A Fourth Step of Transfer Printing Designs:

As shown in FIG. 4, two actuating rollers 82 are separately provided on the opposite sides of the rail space 81 for contacting with two side opposite edges of each leaf 11 after the leaf 11 gets into the rail space 81, and then pushing it forward to pass through between the transfer printing roller 52 and the support roller 53 of the thermo-transfer printing device 50. At this time, the winding roller 60 starts to rotate, forcing the transfer printing paper roll 30 to move forward and press the surface of the leaf 11 synchronously. Thus, the small designs 11 on the transfer printing paper roll 30 can be transferred and printed on the surface of each leaf 11 when the transfer printing paper roll 30 is heated by the transfer printing temperature of the transfer printing roller 52 and compressed by both the transfer printing roller 52 and the support roller 53.

Figure 5:
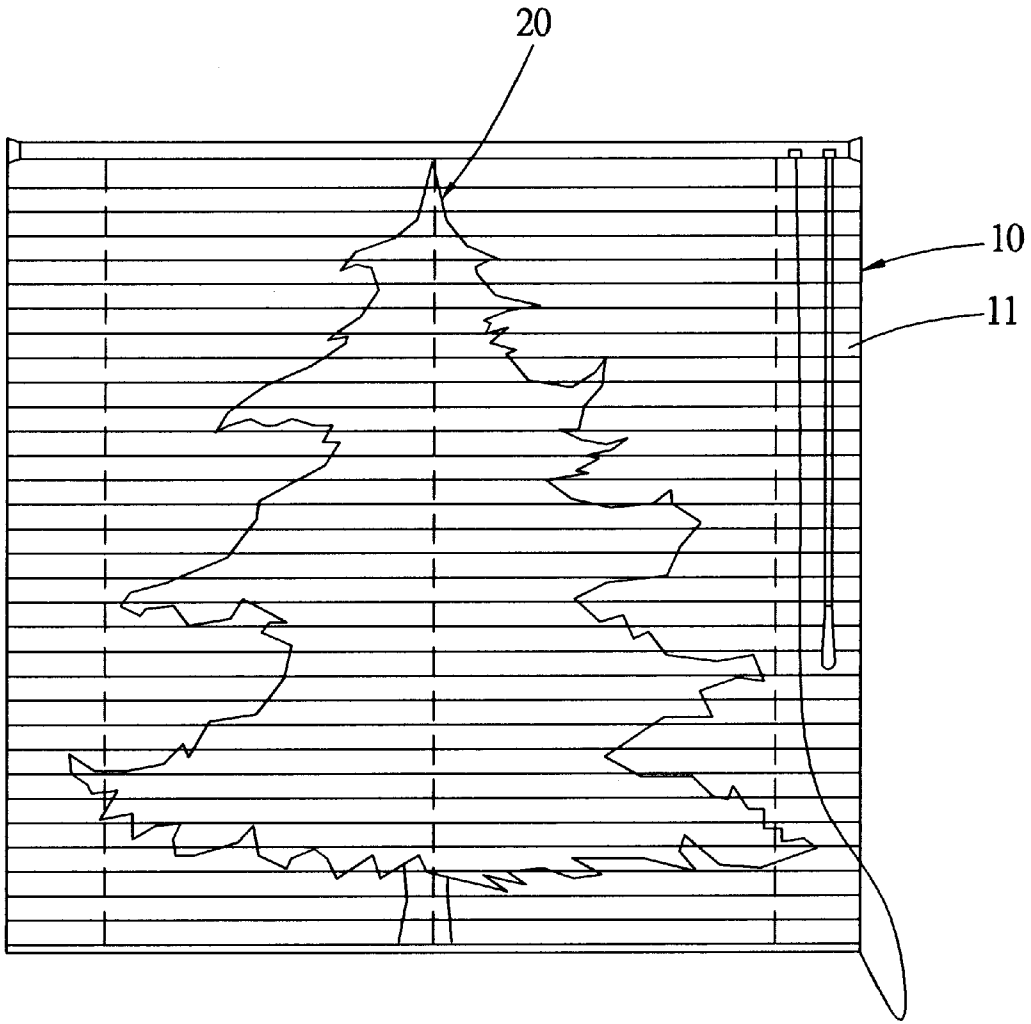
FIG. 5 is a front view of the leaves of a blind having an integral design printed on them by the preferred embodiment in the present invention.

5. A Fifth Step of Arranging and Collecting Finished Leaves:

After finishing transfer printing of the design, the transfer printing roller 52 and the support roller 53 will automatically convey the leaves 11 to material arranging recesses 91 of a material arranging device 90 to be orderly arranged thereon, and at the same time the leaves 11 are piled up, collected together and tied up stably in sequence of the small designs, accordingly acquiring the leaves 11 of a blind 10 having an integral design on them, as shown in FIG. 5.

The heater 51 of the thermo-transfer printing device 20 in this invention can be replaced with a common heat energy tube filled in with highly heated liquid to produce an anticipated transfer printing temperature for the transfer printing roller 52 to use. Besides, the processing of automatically transfer printing designs in this invention requires not too high temperature, so designs can be transferred and printed on the leaves 11 of a bind 10 made of different materials such as aluminum alloy, PVC, non-woven fabric or wood.

Evidently, the method of successively and automatically transfer printing an integral design on the leaves of a blind in this invention is much more efficient than the conventional one which manually performs processing designs, possible to lower processing time and labor, and heightening economic gain. Besides, the transfer printing paper roll in this invention can move forward automatically, and easy to be affixed on or detached from a rotating shaft. Therefore, in case a small amount of the leaves of a blind printed with different designs is ordered, it is none the less convenient to carry on processing designs. In this case, transfer printing paper rolls of different designs required are picked out and orderly installed on the rotating shaft for processing, and after one of the designs is finished processing, instantly another transfer printing paper roll of a different design can be placed to proceed processing and so forth, thus possible to cope with different orders whether in mass production or in small amount production.

While the preferred embodiment of the invention has been description above, it will be recognized and understood that various modifications may be made therein and the appended claims are intended to cover all such modifications that may fall within the spirit and scope of the invention.

I claim:

1. A method of successively and automatically transfer printing an integral design on the leaves of a blind with one round of processing comprising:

(1) A first step of installing transfer printing paper roll: designs to be transfer printed cut into small designs and printed on a transfer printing paper roll, said transfer printing paper roll placed on a rotating shaft and pulled out to pass through a thermo-transfer printing device, said transfer printing paper roll having its end wound around a winding roller:

(2) A second step of distributing and arranging leaves: leaves of a blind having the same sizes of said small designs picked up and respectively placed in separated recesses of a material distributing device, an equal number of said leaves piled up in each said separated recess:

(3) A third step of delivering said leaves: the uppermost one of said leaves in each said separated recess orderly sucked by a sucking disk provided above each said separated recess and conveyed into a rail space of a material delivering device:

(4) A fourth step of transfer printing said designs: said leaves in said rail space orderly moved into a thermo-transfer printing device, said winding roller synchronously starting to rotate to make said transfer printing paper roll press down on said leaf and move it forward, said small designs on said transfer printing paper roll respectively transferred and printed on each said leaf in said thermo-transfer printing device:

(5) A fifth step of arranging and collecting finished leaves: said finished leaves orderly conveyed into material arranging recesses of a material arranging device after transfer printing of said designs, said finished leaves piled up, collected and tied up according to the sequence of said designs to finish said leaves of a blind having an integral said design on them.

2. The method of successively and automatically transfer printing an integral design on the leaves of a blind with one round of processing as claimed in claim 1, wherein said thermo-transfer printing device is composed of a heater, a transfer printing roller and a support roller, said heater located on said transfer printing roller and able to produce heat energy to let said transfer printing roller maintain a definite transfer printing temperature to warm up said transfer printing paper roll, said transfer printing roller and said support roller positioned abutting each other to sandwich, press and carry forward said leaves, said transfer printing paper roll forced to contact closely with and press down on the surface of said leaves to permit said designs transferred and printed on said leaves.

3. The method of successively and automatically transfer printing an integral design on the leaves off a blind with one round of processing as claimed in claim 2, wherein said heater of said thermo-transfer printing device is heated by electrical energy.

4. The method of successively and automatically transfer printing an integral design on the leaves of a blind with one round of processing as claimed in claim 2, wherein the transfer printing temperature of said thermo-transfer printing device is 100–120 C.

5. The method of successively and automatically transfer printing an integral design on the leaves of a blind with one round of processing as claimed in claim 2, wherein inertia rollers of a preset number are respectively provided at the opposite sides of said thermo-transfer printing device for relatively holding said transfer printing paper roll to let said transfer printing paper roll press and move on said leaves smoothly.

6. The method of successively and automatically transfer printing an integral design on the leaves of a blind with one round of processing as claimed in claim 1, wherein the transfer printing temperature of said thermo-transfer printing device is 100–120 C.

7. The method of successively and automatically transfer printing an integral design on the leaves of a blind with one round of processing as claimed in claim 1, wherein inertia rollers of a preset number are respectively provided at the opposite sides of said thermo-transfer printing device for relatively holding said transfer printing paper roll to let said transfer printing paper roll press and move on said leaves smoothly.

8. The method of successively and automatically transfer printing an integral design on the leaves of a blind with one round of processing as claimed in claim 1, wherein said leaves is made of aluminum alloy.

9. The method of successively and automatically transfer printing an integral design on the leaves of a blind with one round of processing as claimed in claim 1, wherein said leaves are made of PVC.

* * * * *